US011957187B2

(12) United States Patent
DeGregorio

(10) Patent No.: US 11,957,187 B2
(45) Date of Patent: Apr. 16, 2024

(54) CLEAVAGE ENHANCING GARMENTS

(71) Applicant: Heather DeGregorio, Fairfield, CT (US)

(72) Inventor: Heather DeGregorio, Fairfield, CT (US)

( * ) Notice: Subject to any disclaimer, the term of this patent is extended or adjusted under 35 U.S.C. 154(b) by 87 days.

(21) Appl. No.: 17/885,500

(22) Filed: Aug. 10, 2022

(65) Prior Publication Data

US 2023/0109425 A1 Apr. 6, 2023

Related U.S. Application Data

(60) Provisional application No. 63/252,982, filed on Oct. 6, 2021.

(51) Int. Cl.
*A41C 3/10* (2006.01)

(52) U.S. Cl.
CPC ..... *A41C 3/10* (2013.01)

(58) Field of Classification Search
CPC ..... A41C 3/0007; A41C 3/122; A41C 3/06; A41C 3/0021; A41C 3/10
See application file for complete search history.

(56) References Cited

U.S. PATENT DOCUMENTS 1,584,525 A * 5/1926 Freeman ..... A41C 3/00 24/697.2
2,475,624 A * 7/1949 Laszlo ..... A41C 3/00 D2/709
2,641,763 A * 6/1953 Schroeder ..... A41C 3/10 450/56
2,660,729 A * 12/1953 Katz ..... A41C 3/0007 450/48
3,491,762 A * 1/1970 Simonsen ..... A41C 3/0021 450/59
3,506,014 A * 4/1970 Sorenson ..... A41C 3/0021 450/86
3,642,009 A * 2/1972 Nobbs ..... A41C 3/0021 450/60
5,098,331 A * 3/1992 Corrado ..... A61F 13/145 450/58
6,755,717 B2 * 6/2004 Smith ..... A41C 3/0057 128/869
7,909,675 B1 * 3/2011 Rainey ..... A41C 3/02 450/59
8,858,295 B2 * 10/2014 Thompson ..... A41C 3/0028 450/10
9,192,197 B2 * 11/2015 Reinhard ..... A41C 3/02
(Continued)

*Primary Examiner* — Gloria M Hale
(74) *Attorney, Agent, or Firm* — Mestechkin Law Group P.C.

(57) ABSTRACT

In one aspect, a functional garment is provided that includes a front panel having a left lateral end and a right lateral end opposite the left lateral end, the front panel comprising a first breast cup and a second breast cup between the left lateral and the right lateral end; a first side panel attached to the left lateral end at a left intersection; a second side panel attached to the right lateral end at a right intersection; and an elastic member attached at a first lateral end thereof to the front panel at the left intersection and at a second lateral end thereof to the front panel at the right intersection, the elastic member configured to apply mediolateral compressive forces to a wearer's breast when the garment is worn.

19 Claims, 4 Drawing Sheets

(56) References Cited

U.S. PATENT DOCUMENTS

| | | | | |
|---|---|---|---|---|
| 10,568,367 | B2 * | 2/2020 | Hawkins-Whetstone | A41C 3/0057 |
| 2003/0166375 | A1 * | 9/2003 | Noel | A41C 3/0057 450/1 |
| 2005/0130558 | A1 * | 6/2005 | Wooten | A41C 3/0021 450/39 |
| 2007/0037482 | A1 * | 2/2007 | Wooten | A41C 3/0021 450/41 |
| 2012/0045967 | A1 * | 2/2012 | Punsal | A41C 3/0057 450/82 |
| 2018/0077974 | A1 * | 3/2018 | Noel | A41C 3/12 |
| 2019/0174840 | A1 * | 6/2019 | Paulson | A41C 3/0014 |

* cited by examiner

CLEAVAGE ENHANCING GARMENTS

RELATED APPLICATION

This application claims the benefit of U.S. Provisional Application No. 63/252,982, filed on Oct. 6, 2021, which is hereby incorporated herein by reference.

BACKGROUND OF THE INVENTION

The present application relates to a functional garment (e.g., brassieres, swimwear tops, bras, etc.), and in more particular to garment tops having for enhancing the cleavage of the wearer (e.g., enhancing the cleavage of a woman wearing a swimsuit top, brassiere, bras, etc.).

Current cleavage-enhancing garments do not provide a way to hold the natural breast tissue in a lifted, elevated, and defined cleavage position. Current cleavage enhancing clothing on the market further allow the natural breast tissue to slip, move, and shift under and around a breast-enhancing filler as the wearer moves, thus reducing the cleavage enhancing effect. Therefore, there is an ongoing need for improved functional garments having a cleavage-enhancing apparatus for enhancing a wearer (e.g., woman's) cleave, to secure the natural breast tissue in an ideal position, to create enough lift, elevation, and/or enhancement of the cleavage, despite movement by the wearer while wearing the functional garment.

SUMMARY OF THE INVENTION

Embodiments of the present disclosure relate to, among other things, a cleavage-enhancing strap for a woman's brassiere or other functional garments. The cleavage-enhancing strap may be secured, sewn into, or otherwise attached to a posterior side of a functional garment (e.g., a brassiere or a woman's swimsuit top) to achieve said cleavage enhancement. One or more insertable fillers (e.g., silicone fillers) may be inserted into enveloping pockets on the posterior side of the functional garment. For example, one insertable filler for each of the wearer's breasts to further the cleavage-enhancing effect.

In one aspect, therefore, a functional garment is provided that includes a front panel having a left lateral end and a right lateral end opposite the left lateral end, the front panel comprising a first breast cup and a second breast cup between the left lateral and the right lateral end; a first side panel attached to the left lateral end at a left intersection; a second side panel attached to the right lateral end at a right intersection; and an elastic member attached at a first lateral end thereof to the front panel at the left intersection and at a second lateral end thereof to the front panel at the right intersection, the elastic member configured to apply mediolateral compressive forces to a wearer's breast when the garment is worn.

In one embodiment, the functional garment includes means attached to ends of the first and side panel and the second side panel for adjustably securing the first side panel to the second side panel.

In one embodiment, each of the first breast cup and the second breast cup comprise a pocket for receiving a filler insert.

In one embodiment, the front panel has a first lateral dimension between the left intersection and the rights intersection, and wherein the elastic member has a second lateral dimension between the left intersection and the rights intersection that is smaller than the first lateral dimension, therewith applying mediolateral compressive forces to the wearer's breast when the garment is worn.

In one embodiment, the second lateral dimension is between 40% and 20% smaller than the first lateral dimension.

In one embodiment, the second lateral dimension is about 32% of the first lateral dimension In one embodiment, the functional garment includes a stay at each of the left intersection and the right intersection.

In one embodiment, the stays are made from a rigid material.

In one embodiment, the stays are disposed at respective intersections vertically.

In one embodiment, the elastic member comprises an elastic strip.

In one embodiment, the elastic member comprises anti-slip material at a posterior side of the elastic member.

In one embodiment, the elastic member comprises an elastic strip attached to the front panel at or below a nipple line of the wearer.

In another aspect, a functional garment is provided that includes a front panel having a left lateral end and a right lateral end opposite the left lateral end, the front panel comprising a first breast cup and a second breast cup between the left lateral and the right lateral end; a first side panel attached to the left lateral end at a left intersection; a second side panel attached to the right lateral end at a right intersection; and an elastic member attached at a first lateral end thereof to the front panel at the left intersection and at a second lateral end thereof to the front panel at the right intersection, wherein the front panel has a first lateral dimension between the left intersection and the rights intersection, and wherein the elastic member has a second lateral dimension between the left intersection and the rights intersection that is smaller than the first lateral dimension, therewith applying mediolateral compressive forces to the wearer's breast when the garment is worn.

In one embodiment, each of the first breast cup and the second breast cup comprise a pocket for receiving a filler insert.

In one embodiment, the second lateral dimension is between 40% and 20% smaller than the first lateral dimension.

In one embodiment, the functional garment includes a rigid stay disposed vertically at each of the left intersection and the right intersection.

In one embodiment, the elastic member comprises an elastic strip having a thickness, wherein the rigid stay extends vertically the thickness of the elastic strip.

In one embodiment, the elastic member comprises anti-slip material at a posterior side of the elastic member.

In one embodiment, the elastic member comprises an elastic strip attached to the front panel at or below a nipple line of the wearer.

Additional aspects of the present invention will be apparent in view of the description which follows.

DETAILED DESCRIPTION OF THE INVENTION

Figure 1:
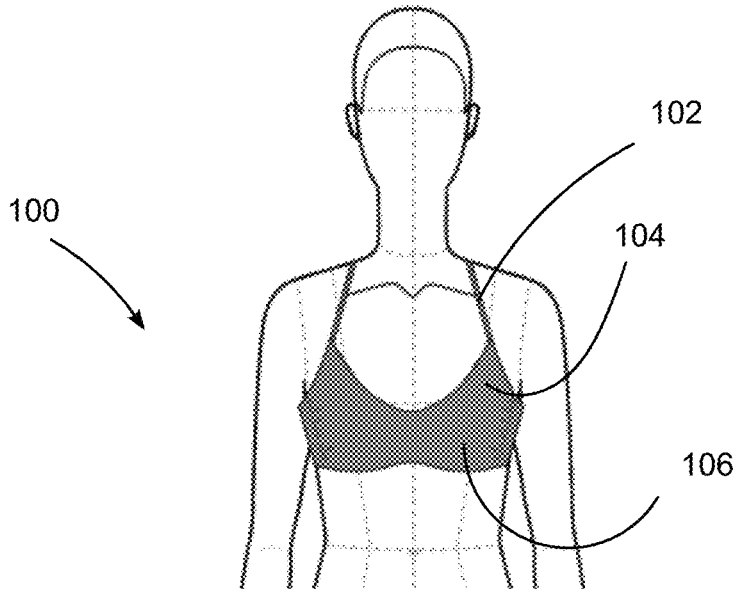
FIG. 1 is a front view of a functional garment according to one embodiment of the garments disclosed herein.
Figure 2:
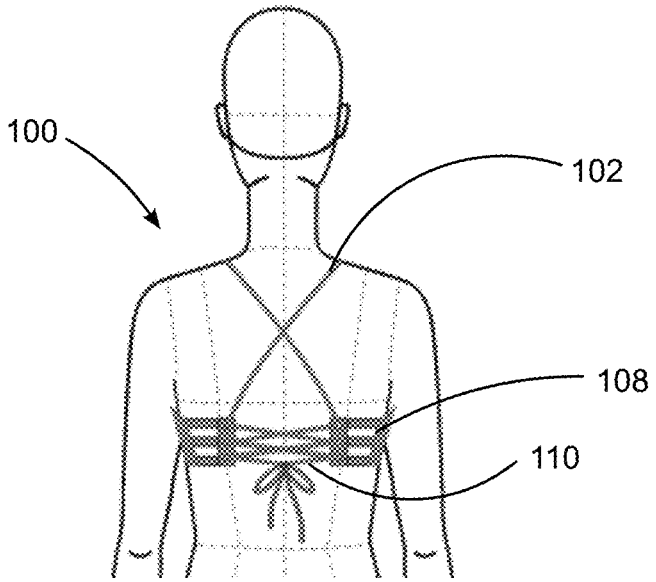
FIG. 2 is a rear view of a functional garment according to one embodiment of the garments disclosed herein.

The present disclosure relates to functional garments and more specifically to swimming suit tops or brassieres for women. In an exemplary embodiment, a functional swimming suit top for women is provided that includes breast supporting device. In some implementations, the breast supporting device includes an elastic and/or flexible member (e.g., a strap made from an elastic or elastomeric material) and optionally one or more insertable filler members 20 (e.g., silicone fillers), as shown in the accompanying figures and as discussed in greater detail below. In an exemplary embedment, the functional garment, as shown in FIGS. 1-2, can be a woman's swimsuit top. In other embodiments, the functional garment may be a brassiere or other garment used to uphold, secure, lift, or otherwise retain a wearer's breast (e.g., a woman's breasts) in a desired position.

Referring to FIG. 1, The functional garment 100 (e.g., woman's swimsuit top), according to an exemplary embodiment, generally has a front panel 104 that includes or otherwise is configured to form two breast cups 106, which correspond to the left and right breasts of the wearer. The front panel is attached to one or more shoulder straps 102, which serve to support the front panel via the wearer's shoulders, as shown. Referring to FIG. 2, the functional garment 100 further includes connecting side panels 108 at each lateral (left and right) end of the front panel 104. Finally, the side panels 108 includes a means for adjustably securing the side panels to each other. Various techniques may be used in this regard, including with a string with eyelets in the connecting side panels, as shown, hooks and loops, interlocking clasps, buttons and holes, etc. In one embodiment, the shoulder straps 102 are used to adjustably secure the side panels together, as shown. That is, a first shoulder strap is attached to a first cup 106 and a second shoulder strap is attached to a second cup 106. The opposite ends of the shoulder straps extend over the wearer's shoulder and lace through a plurality of eyelets in the side panels, therewith allowing the wearer to tie the straps 102 and therewith secure the garment 100 around the torso of the wearer.

Figure 3:
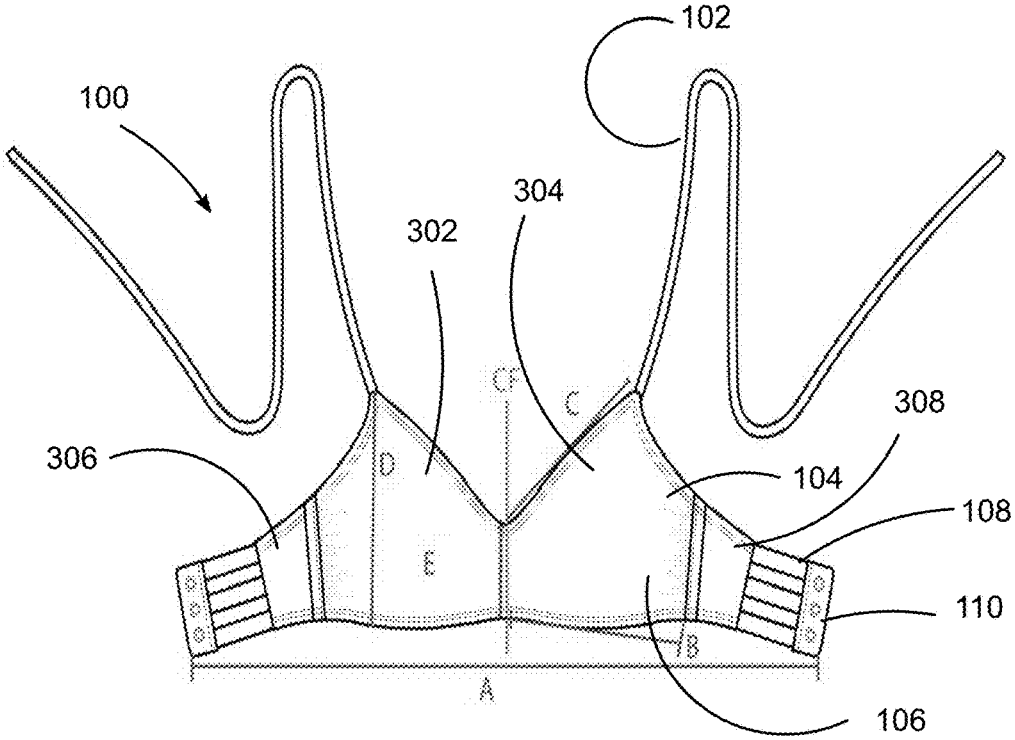
FIG. 3 is a front plan view of a functional garment according to one embodiment of the garments disclosed herein.

FIG. 3 is a front plan view of a functional garment 100 according to one embodiment, showing front panel 104 coupled on left and right lateral ends to connecting side panels 306, 308. Means 110 for connecting the side panels 306, 308 together to form a loop around the wearer's torso are located at the far ends of the panels 306, 308. Exemplary dimensions for the garment (A, B, C, D, and E) are provided in Table A below. It is understood that these dimensions may vary to accommodate the size of wearers.

TABLE A

| | |
|---|---|
| A. ACROSS CHEST FRONT AND BACK | 23" |
| B. BOTTOM BRA LENGTH | 6 ⅜" |
| C. TOP BRA LENGTH | 6" |

TABLE A-continued

| | |
|---|---|
| D. BRA CUP HEIGHT | 7" |
| E. CF BRA HEIGHT | 2 ½" |

Figure 4:
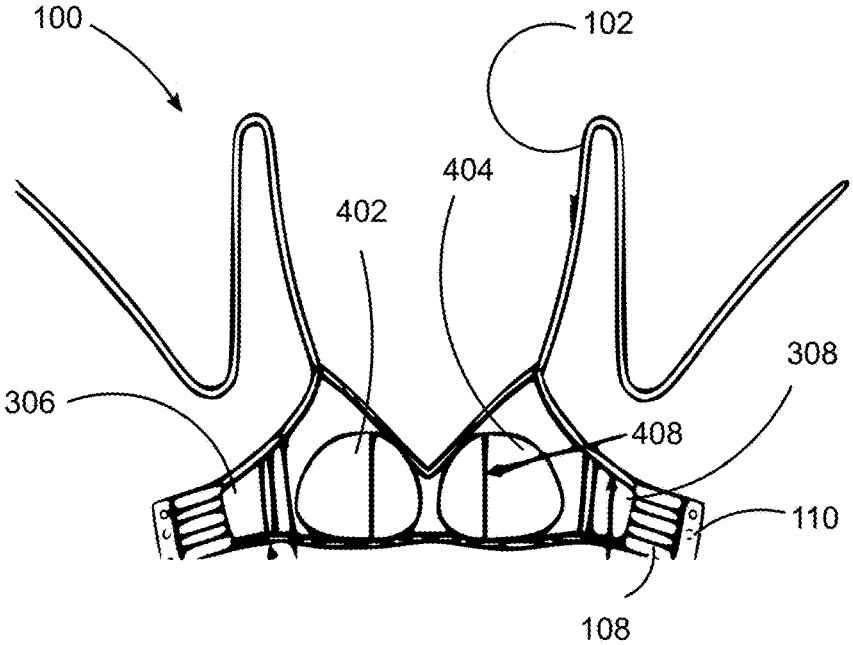
FIG. 4 is a rear plan view of a functional garment according to one embodiment of the garments disclosed herein.

FIG. 4 is a plan view of the posterior (e.g., the inside) of a garment 100, such as a woman's swimming suit top, commonly known as a bathing suit top. In one embodiment, the garment 100 includes an enveloping pocket on the inside of each of the breast cups. That is, a first cup 302 includes a first pocket 404 and a second cup 304 includes a second pocket, each of the pockets having an opening with an overlapping fold 408 therein for retaining items within the pocket, such as insertable fillers, as discussed herein.

Figure 5:
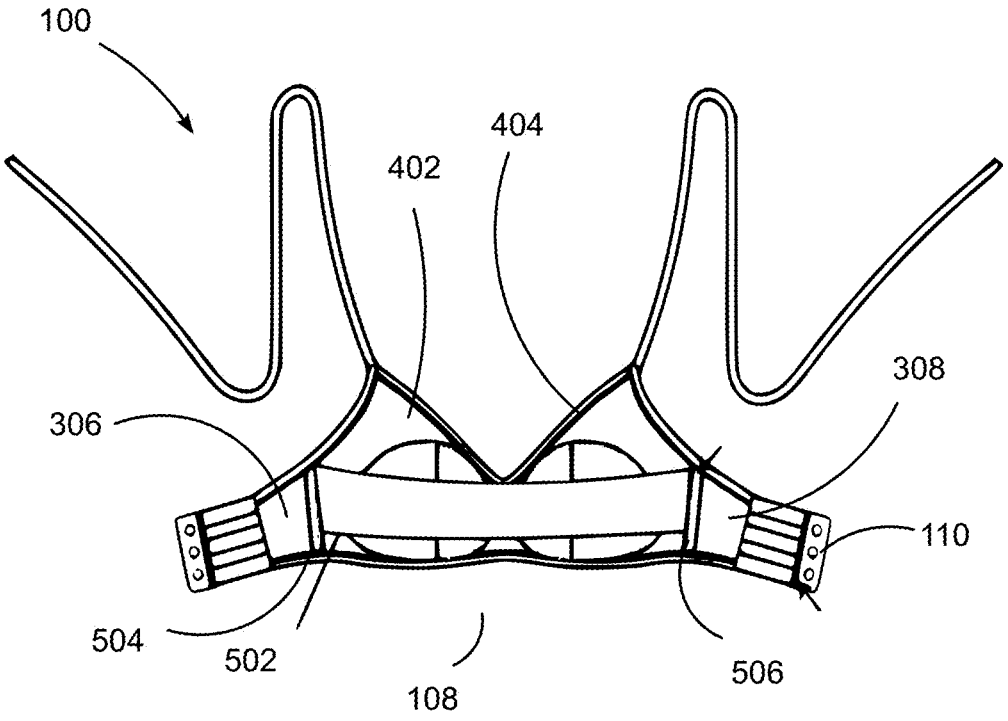
FIG. 5 is a rear plan view of a functional garment according to one embodiment of the garments disclosed herein.
Figure 6:
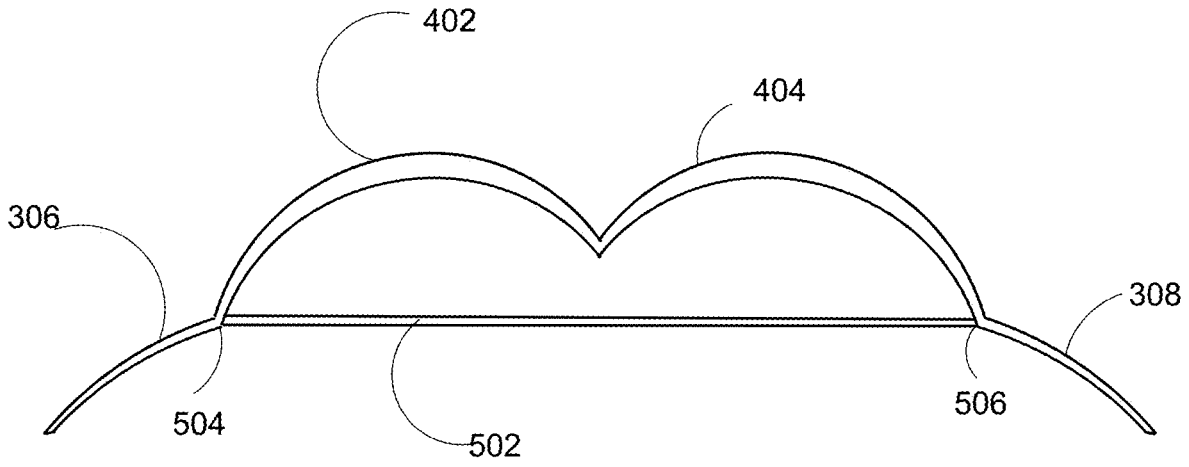
FIG. 6 is a top view of a functional garment according to one embodiment of the garments disclosed herein

FIG. 5 is a plan view of the posterior of a garment 100, according to one embodiment, with an elastic member 502 sewn therein between opposing ends of the front panel 104, as shown. That is, front panel 104 includes a first cup 402 and a second cup 404. A first end of the elastic member 502 is attached to a lateral end of the first cup 402 and a second end of the elastic member 502 is attached to a lateral end of the second cup 404. The lateral dimension of the elastic member 502 is preferably smaller than the corresponding lateral dimension of the front panel 104 so that the elastic member 502 remains in tension when the garment 100 is worn, as shown in FIG. 6 and as discussed below. The elastic member 502 is preferably attached at the intersection/seam of the side panels 306, 308 with the front panel 104. In one embodiment, a stay/rib 504, 508, is sewn into this intersection/seam at each end of the front panel 104. This intersection may be present as a vertical seam, in which case the stay/rib 504, 508 is also a vertical member sufficiently rigid to maintain the orientation of the elastic member 502. It can be appreciated that this construction may be incorporated into any woman's bathing suit top or other similar functional garment, e.g., a woman's brassiere, to achieve a cleavage enhancing effect using the elastic member 502 and/or the insertable filler members.

In an exemplary embodiment, the elastic member 502 may be formed from a 2-inch knit elastic made of polyester and rubber. The elastic member 502 may be formed from other materials, including, but not limited to: braided elastic, woven elastic, clear elastic, cotton elastic, spandex (e.g., Lycra), or some other material with elastic material properties. The elastic member 502 may be formed solely from one of the materials or some combination thereof. Any of these materials may also include silicone strips that would contact the wearer's skin for anti-slip purposes. The elastic member 502, as shown, may be secured, sewn into, attached, or otherwise mounted to the opposing ends of the posterior of the functional garment (e.g., the inside of the women's swimming suit top, as shown). Preferably, the elastic member 502 is attached to extend across the lower half of the breast cups, as shown.

In an exemplary embedment, the elastic member 502 may be a clothing-grade elastic strap sewn into swimwear, bras, tops, dresses, or any other breast-covering clothing item next to or near the side seam, clothing stay, or underwire. In an exemplary embodiment, the elastic member 502 may be formed as an elastic strap. The elastic member 502 may include non-slip silicone strips on the posterior side for anti-slip purposes. In an exemplary embodiment, the elastic member 502 may have the following dimensions: 9.25" in length, 2" in width, and 0.04" in thickness (i.e., height). This length and width may vary with different size tops (XS-XL), e.g., +/−30%-40%. In an exemplary embodiment, the elastic member 502 may be longer and possibly wider for a size large vs a size small (as the clothing item itself would be longer in the front for a larger size and the larger the person usually the larger the natural breasts so the elastic member would possibly have to be wider and the same goes for smaller if doing XS or XXS sizes).

Importantly, the elastic member 502 is functionally shorter than the material it is attached to (i.e., front of a swim top) and wide enough (vertically) so that it does not pinch the natural breast tissue. For example, in an exemplary embodiment, the elastic member 502 may be secured at a length shorter than the functional garment's front (e.g., the front panel 104) of the clothing item in order to create stretch in the elastic when worn. This elastic member 502 (e.g., elastic strap) may hold and position the natural breast tissue of the wearer's breasts up and to the center (e.g., towards the sternum of the wearer). In doing so, the elastic member 502, together with the functional garment, may cause the wearer's breasts to be held in a lifted, elevated, and defined cleavage position.

In an exemplary embodiment, the elastic member 502 may be formed as anatomic cleavage-enhancing strap that may be sewn into the clothing item such that the natural breast tissue of the wearer is set in an ideal position to create desired lift, elevation, and enhancement of the wearer's cleavage. The elastic cleavage-enhancing strap may allow the natural breast tissue to properly sit atop the breast fillers (disposed in the pockets) without shifting during normal movement.

In an exemplary embodiment, the elastic cleavage-enhancing strap 502 may be permanently secured into the breast covering garment, as shown in the Figures, from a lateral aspect of the right side of the body to a lateral aspect of the left side of the body and on the inside of the front of the garment material. The elastic member 502, as shown, is preferably formed from a 2-way stretch knit elastic that is constructed of polyester and rubber. Other combinations of materials may include cotton elastic made of cotton and rubber; nylon elastic made of nylon and rubber; clear elastic made from latex-free polyurethane; or an elastane product (spandex/lycra materials). Any of these may also include silicone strips for anti-slip purposes. The ratio of materials used may change with different size tops (e.g., XXS to XL). An exemplary aspect of the elastic member 502 is that the elastic member may be functionally shorter than the material of the front of the clothing top to create stretch and tension across the natural breast tissue enough to hold it in place during normal movement.

In an exemplary embodiment, the elastic member 502 may be secured just lateral to plastic clothing stays/ribs to create stability of the clothing material so the elastic band of the member 502 can stretch without distorting the clothing front. The elastic member 502 (e.g., elastic strap) may be sewn at a length less than the original clothing item material front. In an exemplary embodiment, the strap may be sewn at a length that is 40%-20%, or preferably about 32% shorter than the material at the front of the garment (e.g., swim top). The elastic member 502, e.g., elastic strap, may be sewn in a position at or just below the natural nipple line of the breast, i.e., in the lower half of the cups.

The elastic member 502 (e.g., the elastic cleavage-enhancing strap) may be secured in any configuration inside the clothing item material so that the clothing item is stable and has tension across the bust line without distorting the clothing front panel. The elastic member 502 may be any length that is shorter than the front of the garment material thus creating tension to secure the natural breast tissue in a lifted, elevated, and enhanced cleavage position. The elastic member 502 may be made of any material that stretches and creates tension across the bust line. The elastic member 502 may be formed of any thickness or width that creates tension across the natural bust line to account for varying bust sizes.

As shown in FIG. 4, one or more enveloping pockets may be stitched into or formed integral with the functional garment of the present disclosure. In an exemplary embodiment, at least one enveloping pocket is provided for each of the breasts of the wearer. For example, and in most cases, an exemplary embodiment of the functional garment may include exactly two enveloping pockets. As described, the one or more pockets 402, 404 may be stitched into a posterior/inner side of the garment (e.g., a brassiere or swimming top).

In an exemplary embodiment, the enveloping pockets 402, 404 may be sewn into the material backs of the clothing item or functional garment just posterior to the elastic member 502 (e.g., elastic strap) to hold a breast enhancing filler. The enveloping pockets 402, 404 may be configured and dimensioned to hold/receive corresponding one more or insertable fillers 20. Each insertable filler may be formed from silicone, foam, or any other bulk-producing material to create fullness under the natural breast tissue and under the cleavage-enhancing strap. The insertable fillers may or may not be removable from the clothing item for washing and care.

OTHER EXEMPLARY EMBODIMENTS

A device for enhancing breasts is provided that includes first and second cups coupled to an elastic member 502 adapted to extend along at least a portion of the back of a user (e.g., wearer). The first and second cups are spaced from each on a front of the user when the device is worn by the user. The device also includes means for enhancing the breasts of the user situated on the device where the first and second cups are coupled to the elastic member 502.

The first and second cups may be adapted to at least partially cover a first breast and a second breast of the user, respectively. The means for enhancing the breast of the user may be adapted to exert a first mediolateral compressive force on a first breast of the user and a second mediolateral compressive force on a second breast of the user.

The means for enhancing breasts (elastic member 502) may be adjustable to increase and/or decrease the first and second mediolateral compressive forces. In an exemplary embodiment, the elastic member 502 may include plastic and/or metal. The elastic member 502 may be rigid and/or semi-rigid. The elastic member 502 may be formed from a soft 2-way stretch or 4-way stretch elastic. The elastic member 502 may be ridged, semi-ridged or have no ridges. There should be clothing stays or underwires in the clothing item for the elastic member to be sewn into to keep the clothing item from collapsing under the tension of the elastic member (so the front of the swim top, brassiere or clothing item retains its natural shape under tension). These clothing stays/underwires could be semi-rigid (plastic) or rigid (metal). These stays or underwires, which are found in many clothing items, would work in conjunction with the elastic member 502 to retain the shape of the clothing item. The first and second cups may be adapted to at least partially conceal the means for enhancing breasts of the user when the device is worn by the user. The means for enhancing breasts of the user may be integrally formed with the member.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A functional garment, comprising:

a front panel having a left lateral end and a right lateral end opposite the left lateral end, the front panel comprising a first breast cup and a second breast cup between the left lateral end and the right lateral end;

a first side panel attached to the left lateral end at a left intersection;

a second side panel attached to the right lateral end at a right intersection; and an elastic member attached at a first lateral end thereof to the front panel at the left intersection and at a second lateral end thereof to the front panel at the right intersection, the elastic member configured to apply mediolateral compressive forces to a wearer's breasts when the garment is worn.

2. The functional garment of claim 1, comprising means for adjustably securing the first side panel to the second side panel attached to ends of the first and side panel and the second side panel.

3. The functional garment of claim 1, each of the first breast cup and the second breast cup comprise a pocket for receiving a filler insert.

4. The functional garment of claim 1, wherein the front panel has a first lateral dimension between the left intersection and the right intersection, and wherein the elastic member has a second lateral dimension between the left intersection and the right intersection that is smaller than the first lateral dimension, therewith applying mediolateral compressive forces to the wearer's breasts when the garment is worn.

5. The functional garment of claim 4, wherein the second lateral dimension is between 40% and 20% smaller than the first lateral dimension.

6. The functional garment of claim 4, wherein the second lateral dimension is about 32% of the first lateral dimension.

7. The functional garment of claim 1, comprising a stay at each of the left intersection and the right intersection.

8. The functional garment of claim 7, wherein the stays are made from a rigid material.

9. The functional garment of claim 7, wherein the stays are disposed at respective intersections vertically.

10. The functional garment of claim 1, wherein the elastic member comprises an elastic strip.

11. The functional garment of claim 1, wherein the elastic member comprises anti-slip material at a posterior side of the elastic member.

12. The functional garment of claim 1, wherein the elastic member comprises an elastic strip attached to the front panel at or below a nipple line of the wearer.

13. A functional garment, comprising:

a front panel having a left lateral end and a right lateral end opposite the left lateral end, the front panel comprising a first breast cup and a second breast cup between the left lateral and the right lateral end;

a first side panel attached to the left lateral end at a left intersection;

a second side panel attached to the right lateral end at a right intersection; and an elastic member attached at a first lateral end thereof to the front panel at the left intersection and at a second lateral end thereof to the front panel at the right intersection, wherein the front panel has a first lateral dimension between the left intersection and the right intersection, and wherein the elastic member has a second lateral dimension between the left intersection and the right intersection that is smaller than the first lateral dimension, therewith applying mediolateral compressive forces to the wearer's breasts when the garment is worn.

14. The functional garment of claim 13, each of the first breast cup and the second breast cup comprise a pocket for receiving a filler insert.

15. The functional garment of claim 13, wherein the second lateral dimension is between 40% and 20% smaller than the first lateral dimension.

16. The functional garment of claim 13, comprising a rigid stay disposed vertically at each of the left intersection and the right intersection.

17. The functional garment of claim 16, wherein the elastic member comprises an elastic strip having a thickness, wherein the rigid stay extends vertically the thickness of the elastic strip.

18. The functional garment of claim 13, wherein the elastic member comprises anti-slip material at a posterior side of the elastic member.

19. The functional garment of claim 13, wherein the elastic member comprises an elastic strip attached to the front panel at or below a nipple line of the wearer.

* * * * *